US006467371B1

(12) United States Patent
Magrini et al.

(10) Patent No.: US 6,467,371 B1
(45) Date of Patent: Oct. 22, 2002

(54) VEHICLE CONTROL DEVICE FOR AGRICULTURE VEHICLES

(75) Inventors: Sergio Magrini, Modena; Ivano Resca, S. Giovanni in Persiceto; Giancarlo Sola, Modena, all of (IT)

(73) Assignee: New Holland North America, Inc., New Holland, PA (US)

( * ) Notice: Subject to any disclaimer, the term of this patent is extended or adjusted under 35 U.S.C. 154(b) by 48 days.

(21) Appl. No.: 09/707,017

(22) Filed: Nov. 6, 2000

(30) Foreign Application Priority Data

Nov. 11, 1999 (IT) ..... BO99A0617

(51) Int. Cl.[7] ..... G05G 1/04

(52) U.S. Cl. ..... 74/525; 74/523; 74/524; 74/528; 74/543; 74/544; 74/545; 74/97.1; 74/471 XY

(58) Field of Search ..... 74/473.26, 97.1, 74/491, 502.2, 523, 524, 525, 528, 543, 544, 545, 471 XY, 501.6

(56) References Cited

U.S. PATENT DOCUMENTS

| | | | | | |
|---|---|---|---|---|---|
| 3,941,008 | A | * | 3/1976 | Cambria | 74/473.28 |
| 4,283,965 | A | * | 8/1981 | Hansen | 74/482 |
| 4,517,855 | A | * | 5/1985 | Lane et al. | 74/528 |
| 4,517,856 | A | * | 5/1985 | Schafer et al. | 74/528 |
| 4,523,489 | A | * | 6/1985 | Gault | 74/473.16 |
| 4,641,545 | A | * | 2/1987 | Rabe | 74/473.19 |
| 4,723,933 | A | * | 2/1988 | Marto | 74/97.1 |

* cited by examiner

*Primary Examiner*—Jack Lavinder
*Assistant Examiner*—Mariano Sy
(74) *Attorney, Agent, or Firm*—Larry W. Miller; John William Stader

(57) ABSTRACT

A vehicle control device, in particular a clutch mechanism for a tractor, includes a control lever and guide mechanism in which the lever is selectively movable from a first rest position to a second engaged position. The control lever is subjected to the action of an elastic apparatus operable to move the lever into the first rest position if the lever is released before reaching a given point along the guide mechanism. The elastic apparatus also being operable to move the control lever into the second engaged position if the control lever is released past the given point.

3 Claims, 8 Drawing Sheets

VEHICLE CONTROL DEVICE FOR AGRICULTURE VEHICLES

BACKGROUND OF THE INVENTION

The present invention relates to a vehicle control device, in particular for agricultural vehicles, such as tractors.

More specifically, the present invention relates to a device for controlling a clutch for transmitting torque to a power take-off of an agricultural vehicle, e.g. a farm tractor, to which the following description refers purely by way of example, in that, as will be clear to an expert in the field, the control device according to the present invention may be used for activating any type of actuator or for initiating any type of operation.

Agricultural vehicles are normally equipped with a power take-off, which is activated or deactivated by a clutch in turn engaged or released by means of a control device.

In Italian Patent Application BO98A000121, for example, a clutch is controlled by a lever movable by the user from a rest to an engaged position, and which is guided along a slot having two circular holes of different diameters corresponding to the rest and engaged positions. More specifically, the rest position hole is larger in diameter than that of the engaged position; and the lever has a locking member stressed by elastic means and comprising a first cylindrical portion, which engages the rest position hole, and a second truncated-cone-shaped portion, which, in the engaged position, is automatically engaged inside the engaged position hole by the elastic means. To switch from the rest to the engaged position, the locking member must be raised by the user to move the lever, and can be released by the user along the slot, even before reaching the engaged position, in which case, the elastic means slide the locking member along the slot and automatically into the engaged position.

Though an improvement on existing devices at the time, actual use of the above control device has revealed several drawbacks which may be eliminated by the control device according to the present invention.

More specifically, the major drawbacks detected in the control device described in Italian Patent application BO98A000121 are the following:

(a) full clutch engagement can only be ensured by allowing the lever a travel angle in excess of normal, to allow for yield of the flexible cable and other members;

(b) poor sensitivity of the lever, during engagement, on account of the sliding friction to which this type of control device is subject; and (c) severe stress on the lever when releasing the clutch, if the user fails to simultaneously release the truncated-cone-shaped portion of the locking member from the engaged position hole; such stress may even result in breakage of the cable, and is uncontrollable by depending largely on the friction between the truncated-cone-shaped portion and engaged position hole.

Accordingly, it would be desirable to provide a clutch mechanism that overcomes these know disadvantages of the prior art.

SUMMARY OF THE INVENTION

It is an object of the present invention to provide a vehicle control device, in particular for agricultural vehicles, that overcomes the aforementioned disadvantages of the prior art.

According to the present invention, there is provided a vehicle control device, in particular for agricultural vehicles;

the device comprising a control lever, and guide means in which the lever is movable by a user from a first rest position to a second engaged position; and the device being characterized in that the lever is also subjected to the action of elastic means for moving the lever into the first rest position if the lever is released by the user before reaching a given point along the guide means; the elastic means also moving the lever into the second engaged position if the lever is released by the user past said given point.

A first major characteristic of the control device according to the present invention is that, by varying the geometry of certain components of the device, it is possible to change both the initial intensity of the resisting moment exerted by the guide, and the law by which said resisting moment varies along the path traveled by the lever between a first rest position and a second engaged position. Adopting a particular guide geometry, the resisting moment of the guide may, if necessary, be maintained substantially constant over the entire angular travel of the control lever.

The user's hand thus becomes sensitive to the mechanical action taking place on the clutch. That is, the resistance of the clutch is, as it were, transmitted instant by instant to the hand of the user, who thus has complete control over engagement of the clutch.

A second major characteristic of the control device is the reduction, in use, of the natural spontaneous rotation stability range of the lever, which stability is mainly due to the friction between the lever and the guide means guiding the lever along a given path. Using an idle roller on the lever and in purely rolling contact with the guide, it is possible to so reduce friction that, if, for any reason, the lever is released by the user before reaching a given point along its path, the lever is forced by the moments involved to return to the rest position. Conversely, if released by the user past said given point along its path, the lever moves spontaneously to a final point of equilibrium, at which the user is certain the control, e.g. a power take-off clutch, is fully engaged.

The action of a spring keeps the roller pressed at all times against the contoured portion of the path, so that forces are generated depending on the slope of a ramp and which assist the rolling movement of the roller just before and just after a given point along its path.

The control device according to the present invention may be used, for example, in the hydraulic power-assist device described in Italian Patent Application BO98A000121, the content of which is considered an integral part of this disclosure. Being a tracking type, the hydraulic circuit of the device described and claimed in Italian Patent Application BO98A000121 provides for accurately and safely modulating engagement of the clutch. When activating the device according to the present invention, the user has the impression of being able to modulate engagement of the clutch effortlessly as required; and, the idle roller on the lever practically eliminates any possibility of jamming along the guided path between the rest and engaged position. As already stated, in the event the lever is released by the user, for any reason, before the clutch is fully engaged, the device according to the invention provides for restoring the lever spontaneously to the rest position, thus preventing possible damage to the clutch.

Once the engaged position is reached and the user's hand releases the lever, the device according to the invention ensures the engaged position is maintained by allowing a certain amount of scope to accommodate any timing errors of the levers, any setting errors, or any increases in length due to settling of the flexible cable connecting the lever to the hydraulic part of the device.

Moreover, when the user turns off the engine, the hydraulic circuit pressure is also cut off, so that, if the power take-off is connected, the return load of the cable increases, thus producing a destabilizing moment greater than the stabilizing engagement moment, so that the lever is restored to the initial rest position in exactly the same way as in the device described in Italian Patent Application BO98A000121.

Moreover, in the rest position, the lever advantageously engages a lateral cavity to prevent accidental engagement of the clutch.

These and other objects, features and advantages are accomplished according to the instant invention by providing a vehicle control device, in particular a clutch mechanism for a tractor, that includes a control lever and guide mechanism in which the lever is selectively movable from a first rest position to a second engaged position. The control lever is subjected to the action of an elastic apparatus operable to move the lever into the first rest position if the lever is released before reaching a given point along the guide mechanism. The elastic apparatus also being operable to move the control lever into the second engaged position if the control lever is released past the given point.

BRIEF DESCRIPTION OF THE DRAWINGS

The advantages of this invention will become apparent upon consideration of the following detailed disclosure of the invention, especially when taken in conjunction with the accompanying drawings, wherein.

DETAILED DESCRIPTION OF THE PREFERRED EMBODIMENTS

Figure 1:
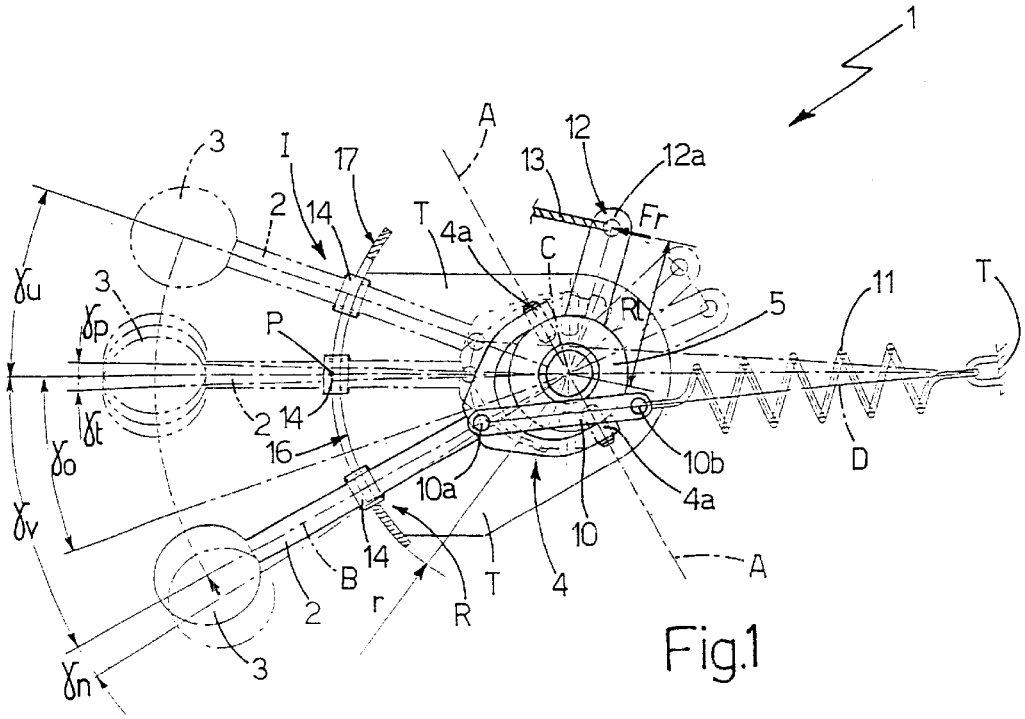
FIG. 1 is a side elevational view of a first embodiment of the control device incorporating the principles of the present invention.

Number 1 in FIG. 1 indicates as a whole a control device, e.g. for engaging a power take-off clutch (not shown) of a tractor (not shown). Device 1 comprises a lever 2, possibly fitted with a knob 3 for easy hand grip of lever 2 by a user (not shown); and, at the opposite end of know 3, lever 2 comprises an integral fork 4 hinged by two hinges 4*a* to a hub 5 along an axis A substantially perpendicular to the longitudinal axis of symmetry B of lever 2. As shown in more detail in FIG. 2, a roller bearing 7 is interposed between hub 5 and a supporting shaft 6 integral with a frame T, to reduce friction between hub 5 and supporting shaft 6, a disk-shaped spacer element 8 with a through hole is inserted between hub 5 and frame T; and, to prevent hub 5 from sliding along its own axis of rotation C, a stop ring 8*a* is fitted to a free end 6*a* of shaft 6. Mechanically, hub 5 and fork 4 integral with lever 2 act as a universal joint enabling rotation of lever 2 abut both axes A and C.

The whole defined by lever 2 and fork 4 comprises a projecting element 9 (FIG. 2) to which is hinged a connecting rod 10. Projecting element 9 and connecting rod 10 are connected at a first end 10*a* of connecting rod 10; a second end 10*b* of connecting rod 10 is subjected to the elastic action of a spring 11 fixed to frame T; and a stop ring 11*a* is provided to secure end 10*a* of connecting rod 10 to projecting element 9.

The device is completed by a rod 12 integral with hub 5 and only shown in FIG. 1 for the sake of simplicity; and to an eyelet 12*a* on rod 12 is connected a cable, e.g. a Bowden cable, 13 for activating a clutch (not shown).

Figure 6:
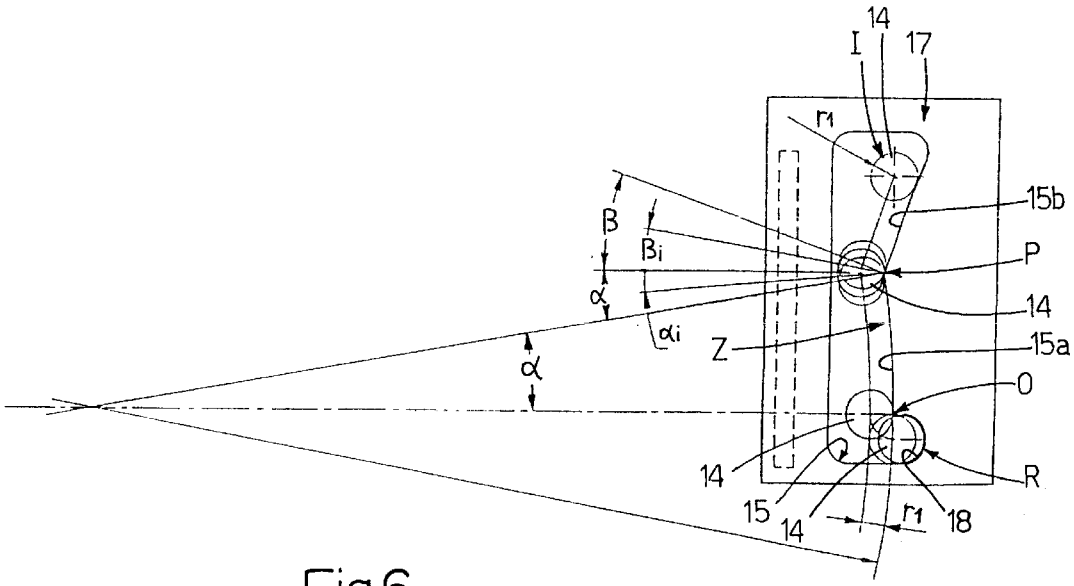
FIG. 6 shows a second embodiment of a guide mechanism for a control lever forming part of either of embodiments shown in FIGS. 1–4.
Figure 5:
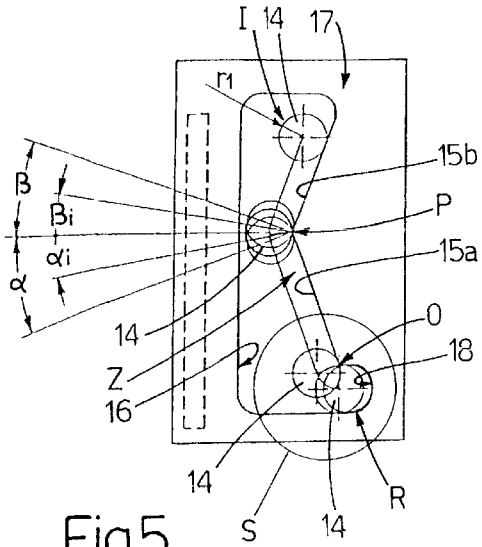
FIG. 5 depicts a first embodiment of a guide mechanism for a control lever forming part of either of the embodiments shown in FIGS. 1–4.

Lever 2 is fitted with an idle roller 14, the outer surface of which is pressed by spring 11 against the ramps 15*a* and 15*b* of a slot 16 formed on a guide 17 (FIGS. 5, 6). As shown in FIG. 1, guide 17 is in the form of a cylindrical sector.

With reference to FIGS. 5 and 6 showing two alternative guides 17, ramps 15*a*, 15*b* define a path Z of roller 14, and hence of lever 2 to which roller 14 is fitted idly, and are separated by a cusp P.

The device is so designed that spring 11 produces anticlockwise moments (FIG. 1) when roller 14 rests on ramp 15*a*, and clockwise moments when roller 14 rests on ramp 15*b*. That is, cusp P marking the passage from ramp 15*a* to ramp 15*b*, and vice versa, represents the dead center of spring 11 where a sharp inversion in the sign of the moments produced by spring 11 occurs (as shown, for example, in FIG. 10*c*).

The user pushes lever 2 manually along path Z to move roller 14 from a first rest position R to a second engaged position I. More specifically, rest position R is located before the start of ramp 15*a*, inside a lateral cavity 18 for preventing accidental engagement; whereas engaged position I is located at a point along ramp 15*b*, and, as explained in detail later on, is determined by the dynamic conditions downstream from device 1.

As shown in the FIG. 10*c* graph, the moment Mm produced by spring 11 on lever 2 is anticlockwise along the ramp 15*a* defined by angular travel $\gamma v$, is of maximum value when roller 14 is in rest position R, and falls to zero when lever 2 is in the position defined by cusp P, i.e. in the spring 11 dead center position. From cusp P onwards, i.e. along ramp 15*b*, roller 14 is forced by the user's hand to travel angular distance $\gamma u$, and the absolute value of moment Mm produced by spring 11 begins rising steadily but opposite in sign (FIG. 10*c*).

As shown in FIG. 1, along angular travel $\gamma n+\gamma v$, spring 11 produces a moment Mm which is added to the moment Mr produced by the resisting force Fr on rod 12 (FIG. 10*a*); this contributes towards the stability of the system. Moment Mr obviously equals force Fr multiplied by an arm which varies as a function of the spatial position of rod 12. Assuming, for the sake of simplicity, that the arm is constant in all system configurations, moment Mr is as shown in the FIG. 10*a* graph.

Conversely, along angular travel γu, spring 11 produces a moment Mm in opposition to the moment Mr produced by the resisting force Fr on rod 12 integral with hub 5.

As a result, and as explained in more detail later on, if lever 2 is released by the operator along ramp 15*a*, moments Mm and Mr restore roller 14 and lever 2 to rest position R; whereas, if lever 2 is released by the operator at any point along the part of path Z traveled by roller 14 along ramp 15*b*, roller 14 and lever 2 are moved into the fully engaged position I substantially defined by the action of the mechanisms downstream from rod 12.

Therefore, whereas the rest position R is defined permanently and corresponds to insertion of roller 14 inside cavity 18, the fully engaged position I may vary over time as a function, for example, of wear on the mechanisms downstream from rod 12.

Force Fr, in fact, obviously depends on the mechanisms downstream from rod 12, such as cable 13, the clutch (not shown), etc.

Figure 2:
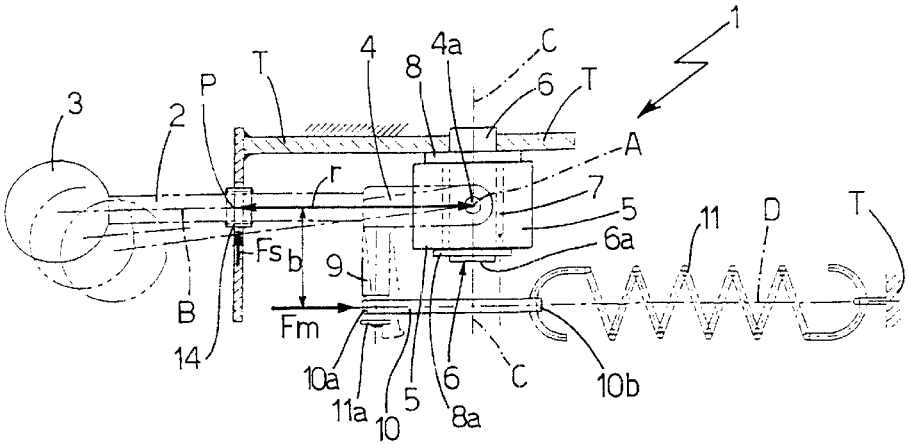
FIG. 2 is a top plan view of the embodiment shown in FIG. 1.

As shown in FIG. 2, equilibrium of the moments in the FIG. 2 plane is given by:

$$Fmb=Fsr \tag{1}$$

where: Fm is the force produced by spring 11; b is the distance separating the longitudinal axis of symmetry D of connecting rod 10 and spring 11 from the longitudinal axis of symmetry B of lever 2 in the spring 11 dead center position; Fs is the reaction pressing lever 2 and roller 14 against ramps 15*a*, 15*b*—in particular, the force by which roller 14 is pressed against cusp P of path Z; and r is the radius of curvature of guide 17 projected on the FIG. 1 plane.

Figure 7:
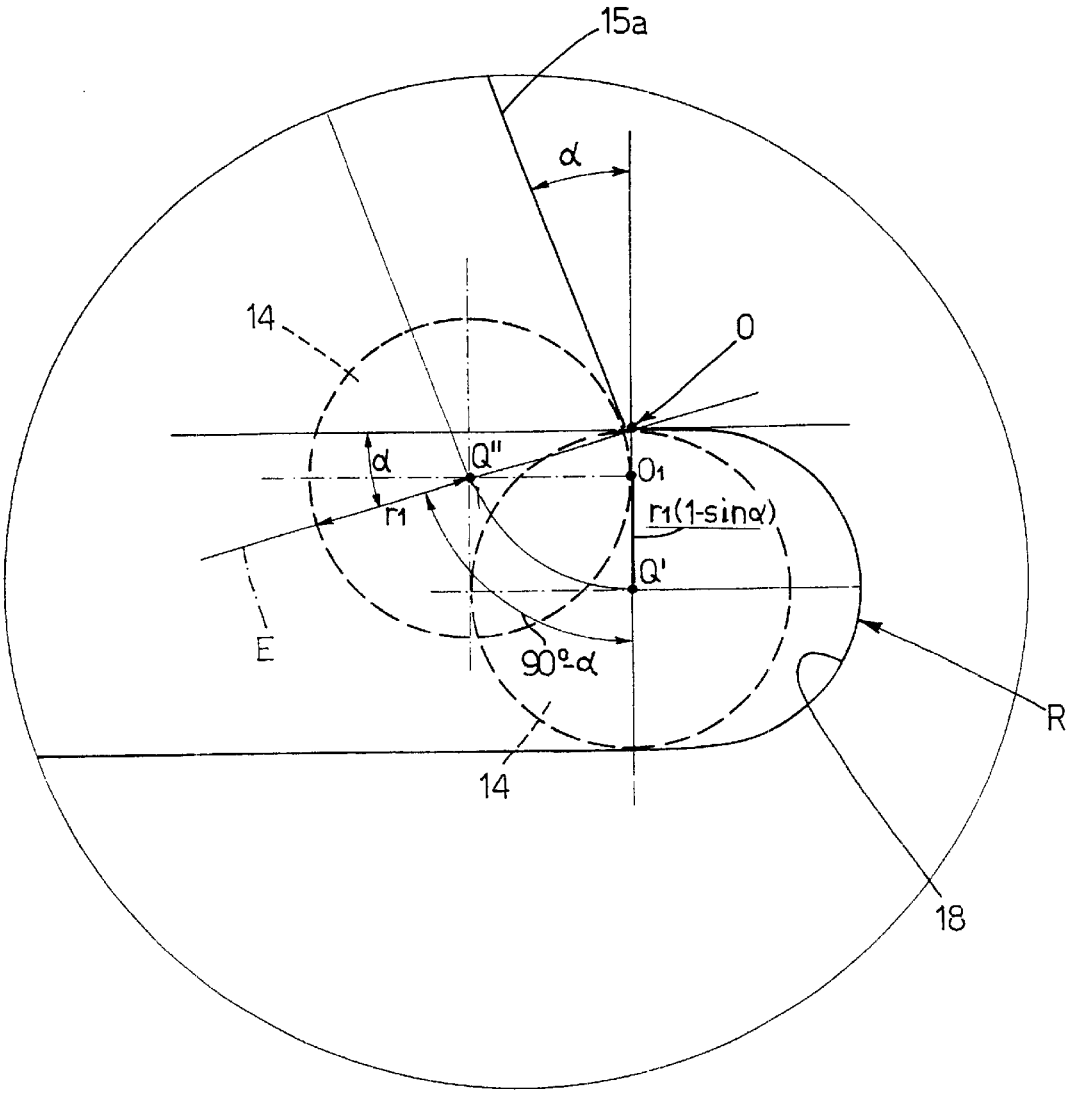
FIG. 7 is an enlarged detail view corresponding to detail S in FIG. 5.

Angle γn is the angle lever 2 has to travel to release roller 14 from rest position R inside cavity 18, and for roller 14 to come to rest at the start point O of bottom ramp 15*a* (FIGS. 5–7). As shown in FIG. 7, the straight line E perpendicular to ramp 15*a* also passes through the center Q" of roller 14. In other words, γn is the angle required to start roller 14 rolling along bottom ramp 15*a*.

Consequently, the following simple trigonometric equation applies:

$$\gamma n=(1-\sin\alpha)(r1/r)(180°/\pi) \tag{2}$$

where: α is the constant slope of bottom ramp 15*a*; r1 is the radius of roller 14; and r is again the radius of curvature of guide 17 projected on the FIG. 1 plane (see also FIG. 2).

It should be pointed out that (r1 (1−sin α)) represents the value by which the center Q' of roller 14 is raised when roller 14 is moved from rest position R to the start of ramp 15*a* (point O, FIG. 7).

For a guide 17 of the type shown in FIG. 6, angle α, is zero, so that the following trigonometric equation, derived from equation (2), applies:

$$\gamma n=(r1/r)(180°/\pi) \tag{3}$$

Along travel γv+γu of lever 2, roller 14 first rolls along bottom ramp 15*a* of slope α, and, once past cusp P, starts rolling along top ramp 15*b* of slope β. At cusp P, roller 14 is subjected solely to force Fs, which, as stated, represents the reaction of ramp 15 on roller 14. As αi and βi progress, a perpendicular component Ft, at distance r from axis C, is produced, and which is given by the following trigonometric equation:

$$Ft=Fstg\alpha i \tag{4a}$$

or:

$$Ft=Fstg\beta i \tag{4b}$$

where: αi and βi are the angles ranging from 0 to α and from 0 to β respectively; and α and β are the angles at which rolling commences along ramp 15*a* and ramp 15*b* respectively.

Equation (4a) obviously applies to bottom ramp 15*a*, and equation (4b) to top ramp 15*b*.

Component Ft reaches maximum intensity when αi=α and βi=β; and, given the orientation of component Ft and trigonometric equations (4a) and (4b), the following equation applies:

$$Ms=Fstg\alpha ir \tag{5a}$$

or:

$$Ms=Fstg\beta ir \tag{5b}$$

That is, substituting the Fs values of equation (1) in equations (5a) and (5b):

$$Ms=Fmtg\alpha ib \tag{6a}$$

or:

$$Ms=Fmtg\beta ib \tag{6b}$$

When αi=α, moment Ms will be maximum and anticlockwise (Ms=Fm b tgα (6c)), on account of roller 14 rolling anticlockwise about point O, to move the lever through an angular travel of:

$$\gamma t=(r1/r)(180°/\pi)\sin\alpha \tag{7a}$$

When βi=β, moment Ms will be maximum and clockwise (Ms=Fm b tgβ (6d)), on account of roller 14 rolling clockwise about point O, to move the lever through an angular travel of:

$$\gamma p=(r1/r)(180°/\pi)\sin\beta \tag{7b}$$

Since ramps 15*a*, 15*b* in FIGS. 5, 7 are of constant slope (α and β), and given the initial assumption ((Fm r) constant throughout the angular travel of lever 2), moment Ms remains constant and maximum for travels γv–γt and γu–γp (FIG. 10*b*).

The smallness of angles γt and γp is an important point to note, because it is within these angles that maximum moment Ms switches from anticlockwise to clockwise. And the faster this occurs, the smaller will be the angular travel γa over which spontaneous rotation stability of the lever (due to friction) exists.

To reduce angles γt and γp, roller 14 must be so selected as to minimize sliding friction—which, as is known, is two orders greater than rolling friction—by appropriately sizing radius r1 of roller 14 with respect to radius r of guide 17. Since, in the example shown:

$$\gamma t=(r1/r)(180°/\pi)\sin\alpha \tag{7a}$$

(r1/r)→0 gives: γt→0.

It is important therefore that r be as large as possible with respect to r1.

Tests have shown that, for satisfactory technical results, (r1/r) must be less than 0.12.

The total resisting moment Mc (FIG. 10*e*) the device is capable of providing by means of spring 11 is the algebraic sum of moment Mm and moment Ms produced by ramps 15*a*, 15*b*.

The load Fr transmitted by connecting cable 13 to rod 12 produces an assumedly constant anticlockwise moment (Mr=Fr R1) (where R1 is the length of rod 12) throughout the angular travel of lever 2.

To prevent lever 2, once released in the fully engaged position I, from returning to rest position R, total resisting moment Mc must overcome Mr throughout travel γu, where γu is the potential travel within which stability of the engaged position is assured.

Figure 10:
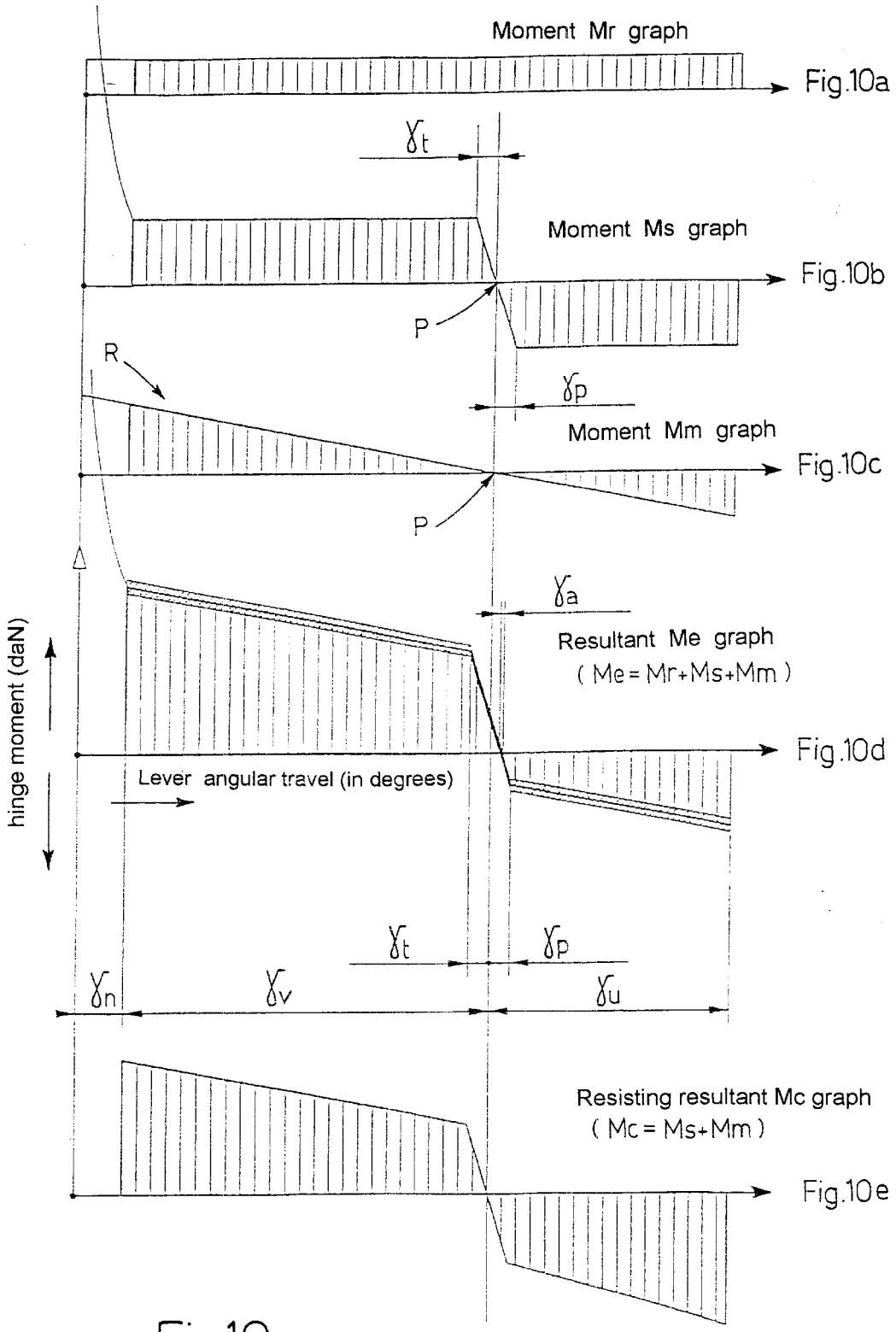
FIG. 10 depicts moment graphs corresponding to the first embodiment of FIGS. 1 and 2 using the guide mechanism shown in FIG. 5.

FIG. 10 shows a sequence of graphs 10*a*–10*e* of moments Mr, Ms, Mm, Me, Mc, where: Mr, as stated, is assumed constant; Ms is the moment produced by ramps 15*a*, 15*b* in FIG. 5, in which cc and D are of the same value; Mm, as stated, is the moment produced by spring 11; Me is the resultant moment of the previous three (Mr, Ms, Mm), i.e. the moment to be overcome manually to activate lever 2. In the FIG. 10*d* graph, the hysteresis range due to sliding and rolling friction of the device has been represented on the resultant moment Me, but minus any friction due to the controlled mechanism.

The Me graph of FIG. 10*d* clearly shows the importance of small γt and γp angles to minimize γa. In fact, γa is none other than the distance, along the x-axis, between the forward and return curves of the hysteresis range. For a given hysteresis, the "faster" the theoretical curve between γt and γp is, the smaller γa will be.

Figure 11:
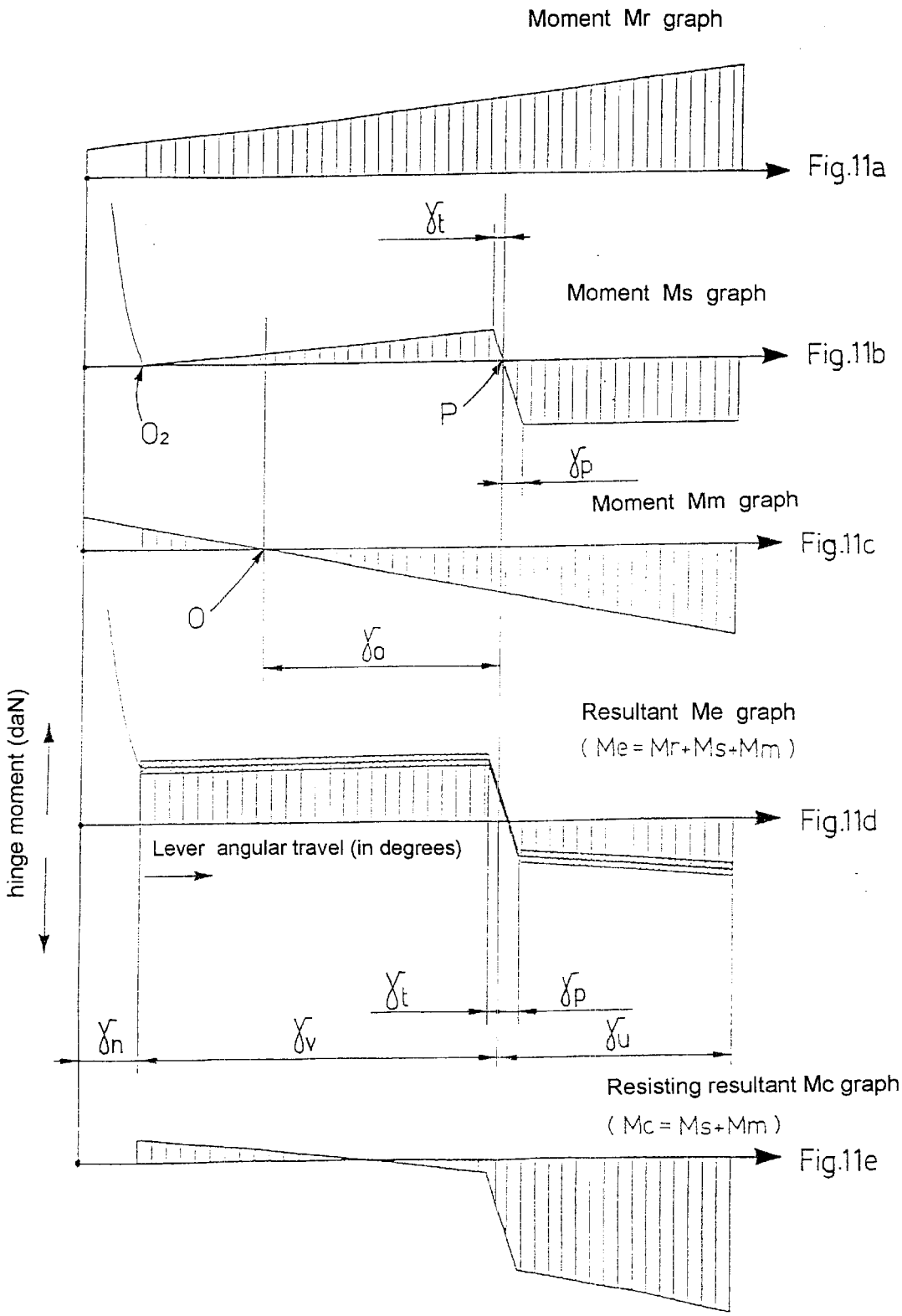
FIG. 11 depicts moment graphs of a fourth embodiment of the control device using the guide mechanism shown in FIG. 6.

In addition to the Mm graph with an advanced dead center of γo (FIG. 1) with respect to cusp P, FIG. 11 also shows a graph of the moment Ms (FIG. 11*b*) which would be achieved using the FIG. 6 as opposed to the FIG. 5 guide 17. Also, as opposed to being constant, moment Mr in FIG. 11 is assumed to vary alongside variations in the rotation angle of lever 2 (FIG. 11*a*).

As shown in the Me graph in FIG. 11*d*, using the FIG. 6 guide 17, moment Me is constant along the whole of ramp 15*a* (throughout travel γu), but varies slightly when roller 14 is on ramp 15*b* (along travel γv), so that, using the FIG. 6 guide 17, the same force must be applied by the user at each point along ramp 15*a* to overcome moment Me.

The designer may therefore, for example, select the shape of ramps 15*a*, 15*b* or the size of angle γo as a function of graphs Me and Mc.

As stated, using control device 1, it is therefore possible, by varying the geometry of certain components of the device, to adjust both the initial intensity of the resisting moment exerted by the guide, and the law by which said resisting moment varies along the path traveled by the lever between a first rest position and a second engaged position. Adopting a particular guide geometry, the resisting moment of the guide may, if necessary, be maintained substantially constant over the entire angular travel of the control lever.

Figure 3:
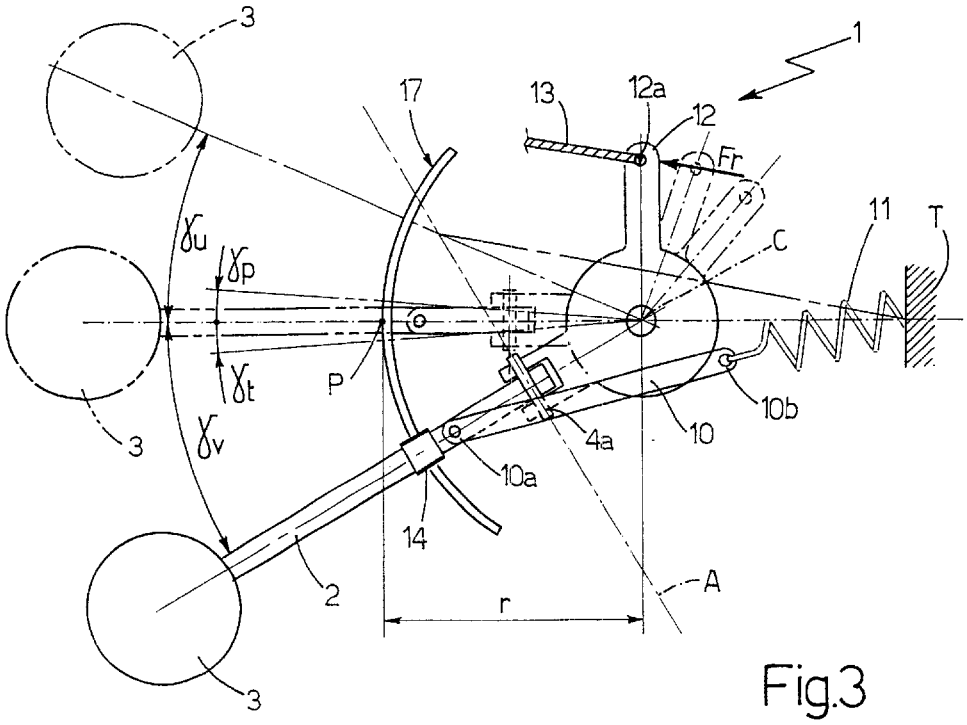
FIG. 3 is a side elevational view of an alternative embodiment of the control device incorporating the principles of the present invention.
Figure 4:
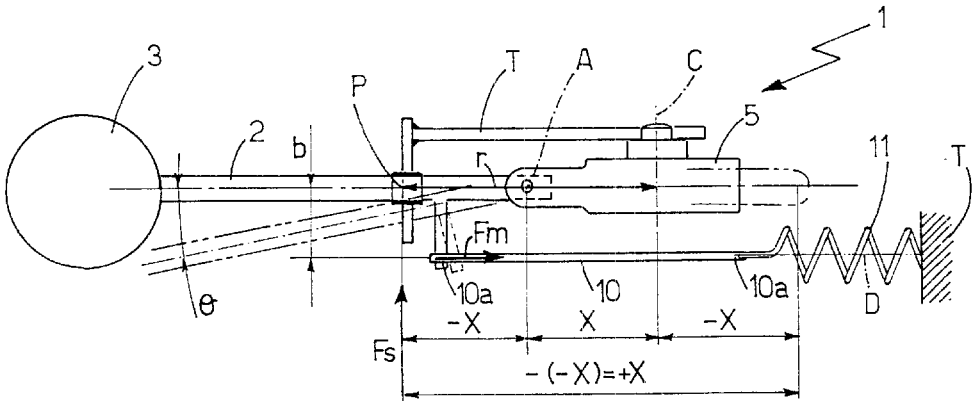
FIG. 4 is a top plan view of the embodiment depicted in FIG. 3.

FIGS. 3 and 4 show a second embodiment of the present invention, in which the hinge axis A of lever 2 extends a distance X from, as opposed to through, axis C (FIG. 4).

This provides for obtaining variations in Fs, and hence in the intensity of Ms for a given α or β value, without altering the arm b of the force Fm produced by spring 11. Using the FIGS. 5 and 6 guides, Ms is obviously varied the same way.

If X is within the radius r of guide 17, as in FIGS. 3 and 4, Fm and all the other parameters being equal, Ms will always be greater with respect to the condition X=0—the configuration considered in FIGS. 1 and 2. Conversely, if X is diametrically opposite the position within radius r of guide 17, Ms will always be smaller with respect to the condition X=0.

Roughly speaking, the following trigonometric equation applies:

$$FmbFs(r-X) \tag{8a}$$

due to equilibrium of the moments about axis A (FIG. 4), which gives:

$$Fs=Fmb/(r-X) \tag{8b}$$

Since equilibrium about axis C gives:

$$Ms=Fstg\alpha r \tag{8c}$$

$$Ms=Fm(r/(r-X))btg\alpha \tag{8d}$$

or, similarly $$Ms=Fm(r/(r-X))btg\beta \tag{8e}$$

where, for X=0, trigonometric equation (6c) or (6d) relative to the first embodiment in FIGS. 1, 2 applies.

With a negative X value, the following trigonometric equation applies:

$$Ms=Fm(r/(r+X))btg\alpha \tag{9a}$$

or:

$$Ms=Fm(r/(r+X))btg\beta \tag{9b}$$

which mathematically translates the case in which axis A of lever 2 is at a diametrically opposite point with respect to guide 17 or radius r.

From equations (8d) and (8e), it obviously also follows that:

$$\text{for } X=r, Ms=\infty \tag{10a}$$

whereas:

$$\text{for } -X=r, Ms=\tfrac{1}{2}Fmbtg\alpha \tag{10b}$$

or $$Ms=\tfrac{1}{2}Fmbtg\beta \tag{10c}$$

$$\text{For } -X\rightarrow\infty, Ms\rightarrow 0 \tag{10e}$$

Also from equations (8d) and (8e), it follows that, for α or β→0, Ms→0; and, for α and β→∞, Ms→∞.

The intensity of Ms may thus be varied as required by working on α, β and X.

It should be taken into account, however, that, as r−X gets smaller, i.e. as X increases, the transverse travel θ of lever 2 as a result of α and β increases. For X=r, i.e. for r−X=0, θ=90°. Moreover, as r−X gets smaller, i.e. as X increases, the stress and friction at the hinge points also increase linearly. In fact, if radius r tends towards zero, for the moments to balance, the value of the forces acting at cusp P must tend towards infinity. The extent to which r−X can be reduced must be assessed in each individual case, and depends on the type of application. Roughly speaking, r−X should not be less than ⅓r. Given the right geometrical and dynamic conditions (e.g. acceptable stress at the hinges, and acceptable angle θ), however, r−X may even be less than ⅓r.

Since the parameters governing Ms and θ are α, β, (r−X) and r (b and Fm being equal), Ms and θ may be fixed, and only or α, β and (r−X) varied.

If a given Ms and θ produce given (r−X), α and β values, α and β must also be reduced alongside a reduction in r−X to keep Ms and θ constant.

Ms being equal, reducing α and β also reduces γt and γp (see equations 7a and 7b).

The advantage lies in reducing the γt+γp range, and hence γa, for a given Ms.

This shows the importance of ramps 15*a*, 15*b*, of the way in which they can be manipulated (FIGS. 5 and 6), and consequently of the possibility of governing both the intensity and the way in which moment Ms varies over the angular travel of lever 2.

Figure 8:
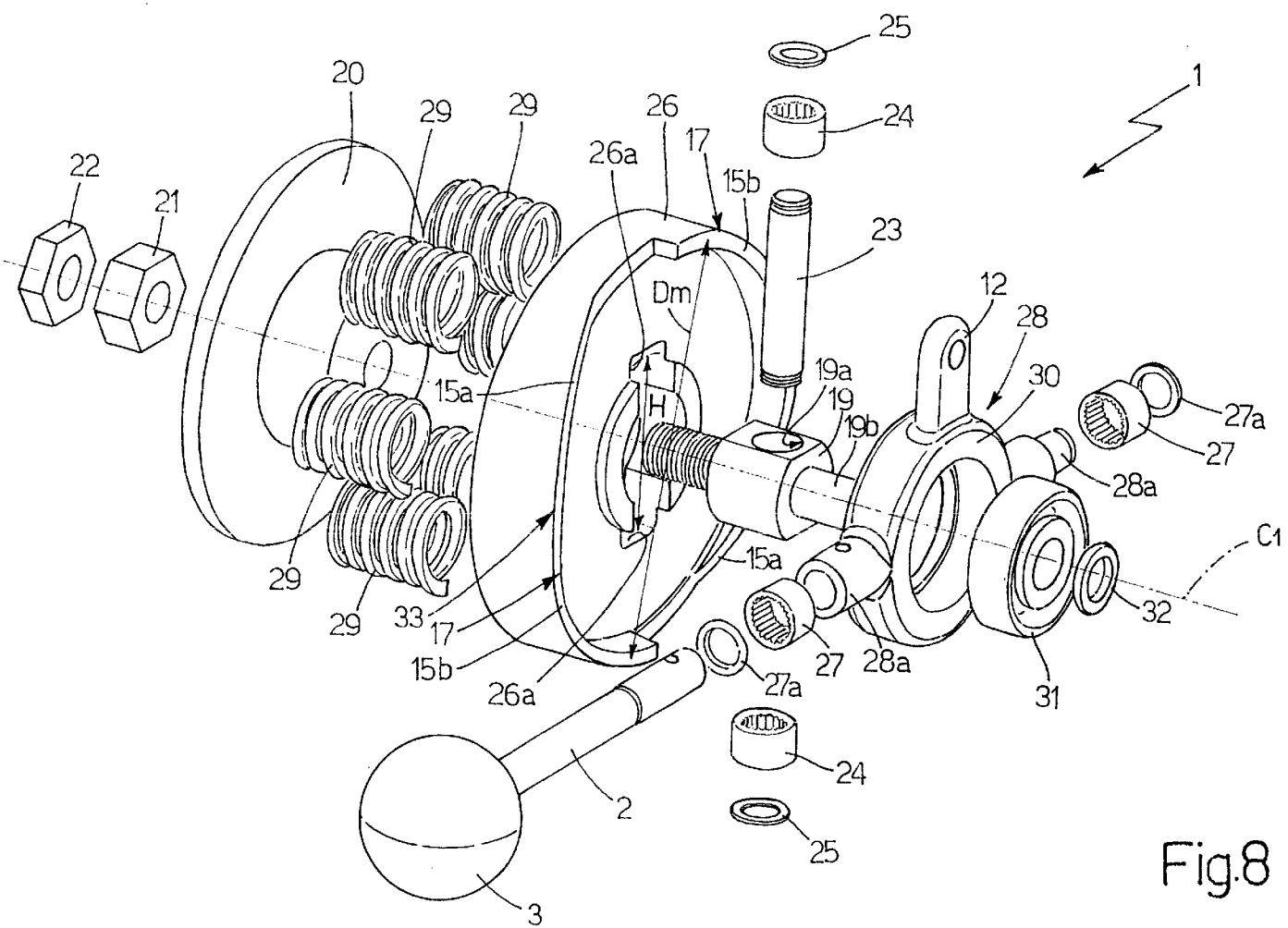
FIG. 8 is an exploded view of a third embodiment of the control device incorporating the principles of the present invention.
Figure 9B:
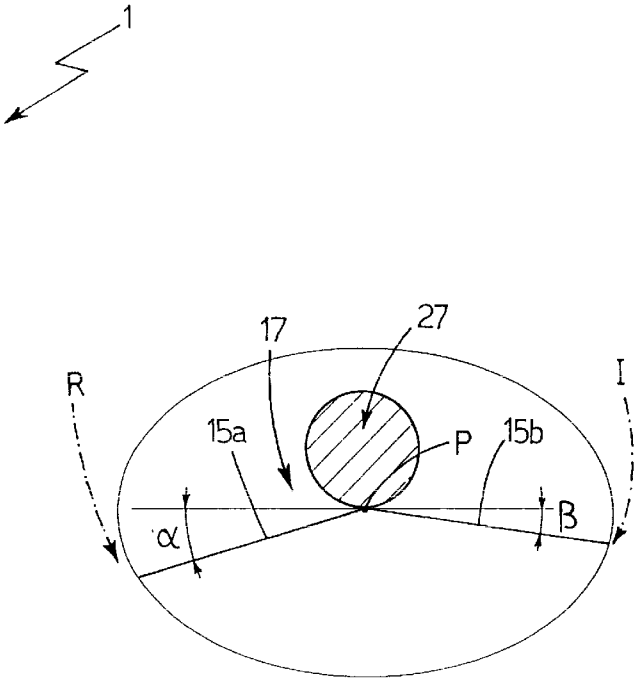
FIG. 9*b* is an enlarged detail view corresponding to the detail K in FIG. 9*a;*
Figure 9A:
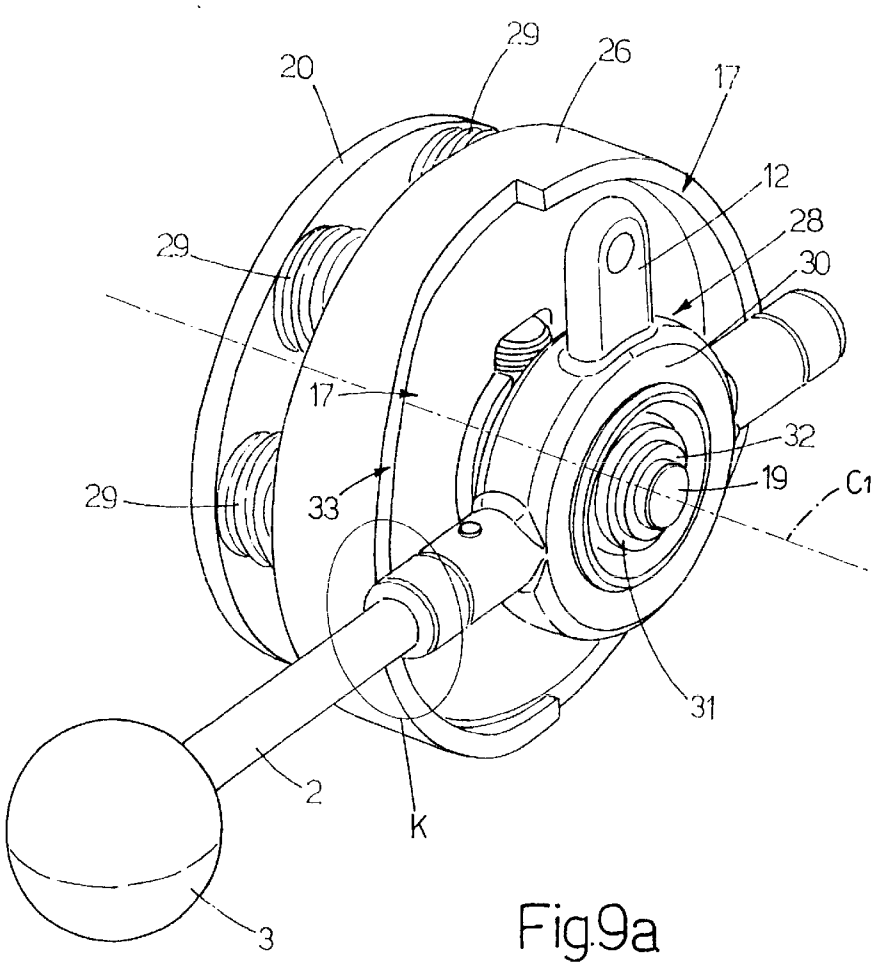
FIG. 9*a* is an assembly drawing for the embodiment of the control device depicted in FIG. 8.

Given what has already been said concerning the operation of ramps 15*a* and 15*b* and characteristic angles γv, γu, γt, γp and γa, a third embodiment is therefore also possible, as shown in FIGS. 8, 9*a* and 9*b*, which shows an enlarged view of detail K in FIG. 9*a*.

This third embodiment is technically more sophisticated than those in FIGS. 1–4, involves less energy dispersion due to friction, provides for better manipulating both the intensity and variation of Ms, and, finally, makes for a more compact device 1.

The third embodiment is particularly interesting when, for reasons of space, lever 2 is allowed no transverse travel θ (FIG. 4), or when, for example, there is no room to connect spring 11 as in the FIGS. 1–4 embodiments. Given the high intensity of Ms and the extremely low hysteresis obtainable with this device, it is also suitable for any application calling for a reduction in the load applied by any mechanism on lever 2. All this, of course, must in no way impair the principal characteristics of device 1 referred to above.

In the third embodiment (FIGS. 8, 9*a*, 9*b*), device 1 comprises a hinge pin 19 fixed to a hub 20 by a nut 21 and lock nut 22, and having a longitudinal axis of symmetry C1. Hub 20 is also fitted, by means not shown in the accompanying drawings, to the frame of the tractor (not shown). A reaction pin 23, with a longitudinal axis of symmetry perpendicular to axis C1, is inserted inside a transverse through hole 19*a* in pin 19, and is fitted at each end with a roller 24 retained axially by a respective ring 25. Each central cavity 26*a* of a drum 26 is engaged by a respective roller 24 of pin 23 with a minimum amount of transverse clearance; drum 26 is pushed against two rollers 27 fitted to a lever body 28 to which lever 2 is connected integrally; each roller 27 is retained axially by a respective ring 27*a*; and the thrust on drum 26 is provided by a number of springs 29 between hub 20 and drum 26.

Lever body 28 comprises a bush 30 in which is inserted an angular-contact bearing 31 retained axially and locked to a portion 19*b* of pin 19 by a ring 32.

The axial load acting on pin 19 therefore equals the total load produced by springs 29.

Drum 26 presses against rollers 27 on ends 28*a* of lever body 28 by a rim 33 shaped in the form of two guides 17, each having a first ramp 15*a* sloping at an angle α, and a second ramp 15*b* sloping at an angle β (FIG. 9*b*). Angles α and β are selected on the same principle as the first two embodiments in FIGS. 1–4; and each guide 17 is symmetrical with and turned 180° with respect to the other.

When lever 2 is activated by the user, bush 30 and lever 2 rotate at all times in a plane perpendicular to axis C1, while drum 26, as a result of the elastic forces generated by springs 29, moves back and forth in a direction defined by axis C1 and as a function of the position of rollers 27 on ramps 15*a*, 15*b*.

During the angular travel of lever 2, and close to the mean diameter Dm of rim 33 of drum 26, two forces are therefore produced perpendicular to the longitudinal axis of rollers 27 on ends 28*a* of lever body 28 and through the centers of rollers 27. Which forces, being opposite in direction, of equal intensity, and lying in said plane perpendicular to axis C1, produce a moment:

$$Ms=FmN^{\circ}Dm/2tg\alpha \tag{11a}$$

or $$Ms=FmN^{\circ}Dm/2tg\beta \tag{11b}$$

depending on whether rollers 27 are on ramp 15*a* or ramp 15*b*.

In equations (11a) and (11b), Fm is the force generated by each spring 29; and N° is the number of springs 29 between hub 20 and drum 26.

Bush 30 has an integral rod 12, to which is fitted a cable (not shown in FIGS. 8, 9) mechanically connecting device 1 to the clutch (not shown).

Dynamically, moment Ms is balanced by a torque reaction:

$$Mr=FrH \tag{12a}$$

where: Fr are the equal, opposite forces also lying in a plane perpendicular to axis C1 of pin 19, and which may be assumed to pass through the centers of rollers 24 on the ends of pin 23; and H is the distance between the centers of rollers 24. Fr are therefore the forces with which cavities 26*a* of drum 26 push against rollers 24 of pin 23 as a result of Ms tending to rotate drum 26, so that the rotation stability of drum 26 about axis C1 is assured.

In all three embodiments shown in FIGS. 1–4, 8, 9, as opposed to using roller 14 and rollers 27 respectively, ramps 15*a*, 15*b* may be covered with material (e.g. plastic) to drastically reduce sliding friction between ramps 15*a*, 15*b* and lever 2.

The total efficiency of the FIGS. 8 and 9 device is extremely high and equal to 0.98, due to the purely rolling friction involved. The third embodiment also provides for offsetting drum 26 with respect to lever 2—which still retains its own R and I positions—by rotating and locking drum 26 in the new position by means of pin 23, pin 19, nut 21 and lock nut 22.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention. Accordingly, the following claims are intended to protect the invention broadly as well as in the specific form shown.

What is claimed is:

1. In a vehicle control device having a control lever and an associated guide apparatus along which said control lever is movable from a first rest position to a second engaged position, the improvement comprising:

an elastic device operatively associated with said control lever for moving said control lever into said first rest position when said control lever is being moved independently of said elastic device and released from said independent movement before reaching a preselected point along said guide apparatus, said elastic device also being operable to move said control lever into said second engaged position when said control lever is released from said independent movement after reaching said preselected point along said guide apparatus;

said control lever rotates about a first axis and about a second axis oriented perpendicularly to said first axis, said first and second axes lying in a common plane; and said guide apparatus is formed as a cylindrical sector located a distance from said second axis.

2. The vehicle control device of claim 1, wherein said elastic device is an extension spring.

3. The vehicle control device of claim 2 wherein said control lever includes an idle roller fixed thereon and said cylindrical sector includes a pair of ramps; and said roller held into constant contact with one of said pair of ramps by said extension spring.

* * * * *